US006438207B1

(12) United States Patent
Chidester et al.

(10) Patent No.: US 6,438,207 B1
(45) Date of Patent: Aug. 20, 2002

(54) X-RAY TUBE HAVING IMPROVED FOCAL SPOT CONTROL

(75) Inventors: Charles Lynn Chidester, West Bountiful; Mark Alan Heber, Riverton, both of UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/395,709

(22) Filed: Sep. 14, 1999

(51) Int. Cl.[7] ..... H01J 35/14

(52) U.S. Cl. ..... 378/138; 378/121; 378/119; 378/140; 378/130

(58) Field of Search ..... 378/138, 119, 378/121, 140, 142, 130

(56) References Cited

U.S. PATENT DOCUMENTS

| | | | | | |
|---|---|---|---|---|---|
| 3,250,916 | A | | 5/1966 | Rogers | 250/60 |
| 3,783,333 | A | | 1/1974 | Atlee | 315/30 |
| 3,875,028 | A | * | 4/1975 | Atlee et al. | |
| 3,916,202 | A | | 10/1975 | Heiting et al. | 250/403 |
| 3,962,583 | A | | 6/1976 | Holland et al. | 250/402 |
| RE30,082 | E | * | 8/1979 | Atlee et al. | |
| 4,373,144 | A | | 2/1983 | Franke | 313/338 |
| 4,689,809 | A | | 8/1987 | Sohval | 378/136 |
| 4,764,947 | A | | 8/1988 | Lesensky | 378/138 |
| 5,125,019 | A | | 6/1992 | Evain et al. | 378/137 |
| 5,224,143 | A | | 6/1993 | Dumitrescu et al. | 378/136 |
| 5,689,542 | A | * | 11/1997 | Lavering et al. | 378/142 |
| 6,115,454 | A | * | 9/2000 | Andrews et al. | 378/140 |

* cited by examiner

*Primary Examiner*—David P. Porta
*Assistant Examiner*—Pamela R. Hobden
(74) *Attorney, Agent, or Firm*—Workman, Nydegger & Seeley

(57) ABSTRACT

An x-ray tube having a cathode and an anode disposed within an evacuated housing is disclosed. The cathode is spaced apart from a target surface formed on the anode and the anode is placed at a positive voltage relative to the cathode so that electrons emitted from the cathode accelerate towards and strike the target surface at a focal spot. The resulting collision produces x-rays. The cathode assembly includes a cathode support base, upon which is mounted a filament for emitting electrons. A first focusing mechanism focuses the emitted electrons into an electron beam. In illustrated embodiments, a pair of deflector plates are also supported upon the cathode support base. Voltage potentials are applied to the deflector plates so as to create a deflection region which alters the trajectory of the electron beam and thereby reposition the focal spot on the anode target. The cathode assembly also includes as secondary focusing mechanism, formed as a focusing aperture, that further focuses the electron beam before it exits the cathode assembly. The focusing aperture has a size and a shape that provides controls the size and the shape of the focal spot. In preferred embodiments, the aperture is formed within a housing that substantially encloses the filament, the deflector plates and the cathode cup. Preferably the housing is at the same electrical potential as the cathode cup. The housing electrically and physically isolates the cathode assembly from the anode, thereby reducing arcing between the two and reducing the amount of heat that is radiated to the cathode.

22 Claims, 3 Drawing Sheets

X-RAY TUBE HAVING IMPROVED FOCAL SPOT CONTROL

BACKGROUND OF THE INVENTION

1. The Field of the Invention

The present invention relates generally to x-ray tubes. More particularly, embodiments of the present invention relate to an x-ray tube having the capability to control the position, size and shape of focal spots on an anode target.

2. The Relevant Technology

X-ray producing devices are extremely valuable tools that are used in a wide variety of applications, both industrial and medical. For example, such equipment is commonly used in areas such as diagnostic and therapeutic radiology; semiconductor manufacture and fabrication; and materials analysis and testing.

While used in a number of different applications, the basic structure and operation of x-ray devices is similar. X-rays, or x-radiation, are produced when electrons are produced, accelerated to a high speed, and then stopped abruptly. Typically, this entire process takes place within a vacuum formed within an x-ray generating tube. An x-ray tube ordinarily includes three primary elements: a cathode assembly, which is the source of electrons; an anode, which is axially spaced apart from the cathode and oriented so as to receive electrons emitted by the cathode; and some mechanism for applying a high voltage for driving the electrons from the cathode to the anode. Usually, the cathode assembly is composed of a metallic cathode head having a cathode cup. Disposed within the cathode cup is a filament that, when heated via an electrical current, emits electrons.

The three x-ray tube elements are usually positioned within an evacuated glass tube and connected within an electrical circuit. The electrical circuit is connected so that the voltage (generation element can apply a very high voltage (ranging from about ten thousand to in excess of hundreds of thousands of volts) between the anode and the cathode. This high voltage differential causes the electrons that are emitted from the cathode filament to accelerate at a very high velocity towards an x-ray "target" positioned on the anode in the form of a thin stream, or beam. The x-ray target has a target surface (referred to as the focal track) that is comprised of a refractory metal. When the electrons strike the target surface, the kinetic energy of the striking electron beam is converted to electromagnetic waves of very high frequency, i.e., x-rays. The resulting x-rays emanate from the anode target surface, and are then collimated through a window formed in the x-ray device for penetration into an object, such as an area of a patient's body. As is well known, the x-rays that pass through the object can be detected and analyzed so as to be used in any one of a number of applications, such as x-ray medical diagnostic examination or material analysis procedures.

The area upon which the electron beam is concentrated when it strikes the anode target surface, or focal track, is referred to as the "focal spot." In most x-ray applications, it is important that the local spot have a specific size and/or shape so as to result in the generation of an x-ray signal that provides an acceptable image quality. This "focusing" of the electron beam is provided primarily at the cathode, which constrains the emitted electron cloud and accelerated electron stream in a manner so as to result in a focal spot having a specific size and shape.

In addition to the need for a focused electron beam, in some applications—such as diagnostic radiology for example—there is a need to generate two or more different x-ray beams having different energy characteristics, and/or two or more x-ray beams that have different angles of incidence upon the area being analyzed, such as the patient's body. In general, this can be achieved by providing two or more separate focal spots on the focal track. Each focal spot (i.e., point of impact of electrons) will thus generate a separate and distinct x-ray signal, and each signal can thus have a desired characteristic (e.g., energy characteristic, angle of incidence, etc.).

In general, providing an x-ray tube that is capable of generating multiple focal spots of specific size and shape has proven difficult. One approach is to utilize an x-ray tube having multiple cathode head structures. With this approach, a separate cathode with its own cathode cup, heated filament and electrical circuit, is provided. Each cathode is then physically oriented with respect to the anode target surface in a manner so as be capable of generating a separate focal spot. While this approach does result in the generation of multiple x-ray signals, it is not entirely satisfactory for several reasons. It requires additional structural components within the x-ray tube, which increases manufacturing cost and complexity, and increases the likelihood of component failure. Moreover, the number of focal spots that can be produced is limited by the number of cathode structures provided, thereby limiting the number and types of x-ray signals that can be produced.

Another approach for producing multiple x-ray signals is to provide some facility for redirecting or displacing the point of impact of the electron beam (i.e., the focal spot) to different positions on the focal track. These approaches typically utilize a voltage potential to deflect the electron beam after it has been emitted from the cathode filament. However, x-ray tubes using these approaches have not been entirely satisfactory either. For instance, in designs of this sort a deflection mechanism, such as multiple deflection plates, is usually disposed external to the cathode. In operation, a voltage potential is applied to the deflection plates, which creates a deflection region between the cathode and the anode target. Typically, one plate is placed at a much higher negative voltage with respect to the other deflection plate. This voltage bias acts to deflect and alter the direction of the accelerating electron beam, and thus causes it to impinge on a different focal spot location on the anode target surface.

The use of these deflection plates cause several problems that can negatively affect the quality of the resulting x-ray signal. First, in some designs the deflection plates are positioned external to the focusing structure of the cathode cup. Thus, the electron beam has already been formed and focused, and is accelerating towards the anode before it reaches the deflection region. At this point, the electrons are already traveling at a high rate of speed and have therefore achieved an appreciable amount of energy. As such, deflection of the electron beam to alter its direction requires that a high voltage potential be applied to the deflection plates. However, higher voltage can result in arcing between the deflection mechanism and the anode structure, which can render the tube inoperable. To alleviate this problem, the anode must be physically spaced farther from the cathode structure. However, moving the target farther from the anode results in lower x-ray emission, thereby decreasing the quality of the x-ray image. This is not acceptable in many applications. Designs utilizing external deflection plates must thus limit the amount of voltage potential used to steer the electron beam (to maintain the stability of the tube and avoid electrical arcing). This limits the degree to which the electron beam can be deflected. Alternatively, such designs must increase the distance between deflection plates and the anode, which decreases the x-ray emission quality due to the resulting increase in distance between the anode and the cathode.

Another problem with the use of such external deflection plates is that the physical position of the plates relative to one another and relative to the cathode cup and filament, can greatly affect the ability to precisely steer the electron beam. However, each of the plates is typically supported by a separate support structure. Thus, mechanical precision is difficult to achieve, and can result in an expensive and time consuming, manufacturing and assembly process. Moreover, repeated use of the x-ray tube—especially in the extreme thermal and vibrational conditions of an operating x-ray tube—can cause deformation of the deflection plates relative to one another. This reduces the operational efficiency of the tube, and can result in a tube having a shorter operational life.

As can be seen, the problems encountered when using external plates are due in large part to the physical distance between the plates and the electron emission source, or filament. However, moving the plates closer to the filament creates other problems, namely, by adversely affecting the emission region of the filament. This is due primarily to the manner in which electrons are emitted, or "boiled" off, from the filament. In generals electrons are boiled off from the filament at a minimum energy level, which is dependent on the filament material (e.g., approximately 4.5 eV for tungsten). If after being boiled off the filament the electrons encounter a retarding field with greater than this minimum exit energy, the electrons are returned to the filament, forming an electron cloud. This circumstance affects the transmission qualities of the electron beam that is accelerated towards the anode target, e.g., the emission region can narrow and/or shift. In contrast, if the electrons immediately encounter in accelerating field, they accelerate towards the target and gain energy. The resultant beam has minimal electron emission variation from the filament. Consequently, positioning the deflection plates close to the filament can result in a diffuse electron source that compromises the focusing capability of the cathode structure.

Examples of this, as well as other problems can be seen in those x-ray tube designs that have attempted to address the problems inherent with the use of external deflection plates by moving the deflection function closer to the electron source. For example, one approach is to eliminate the use of separate physical deflection plates, and instead deflect the electron beam with the cathode focusing cup itself. These designs essentially split the cathode focusing cup into different and electrically insulated parts, and then apply the voltage bias to the separate parts so as to deflect the electron beam. Thus, there is no separation of the focusing and deflection functions, insofar as both are provided within the cathode focusing cup itself. This focusing and deflection of the electron beam with the same structure reduces the ability to provide a well controlled electron beam and tightly controlled and focused focal spot at the anode target. For example, there is no ability to independently focus, control, modify and/or deflect the electron beam trajectory or shape since all of this is done simultaneously within the same cathode structure. Thus, there is no ability to allow separate control over the electron beam parameters and focal spot size and/or dimensions. Also, in operation, only the filament portion of the cathode structure is at "cathode" potential, and the remaining parts of the cathode are at a specified deflector bias potentials. Thus, such a structure has varying bias voltages and varying electron emission levels depending on the applied AC voltage. Moreover, because of the proximity to the electron filament source, the electron emission levels will also vary depending on the applied deflector bias. Also, the electron optics provided by such a structure are complicated and difficult to control and define due to the moving electron source region of the filament, which is again affected by the particular deflector bias. For instance, as noted above, when a bias is applied in such devices, the emission region of the electron beam typically narrows and shifts.

To address the problems resulting from integrating the deflector function into the cathode cup itself, some x-ray tubes utilize deflectors that are attached directly to the cathode cup focusing device via an insulator. However, such an approach still has the stability problems found in devices using separate deflector plates (i.e., less tube stability due to arcing between the grids and the cathode); and also have some of the same problems encountered in approaches integrating the function within the cathode cup, i.e., reduced emissions and space charge limitations. Since the deflector grids are only separated from the focusing cup by an insulator, the plates still compromise the focusing ability of the cathode structure. Again, the electrons emitted from the filament immediately encounter a retarding field created by the bias applied to the deflector plates that is negative with respect to the cathode. This creates emission and space charge limitations that limit the focusing ability of the cathode. Moreover, the length of the deflector plates along the beam axis cause a lensing action, which is due to the curvature of the electric field lines which penetrate into the filament opening. This further reduces the focusing capability of the cathode structure.

Because of the problems with tube stability, and the reduced focusing capability of the cathode structure, previous cathode designs for providing adjustable focal spots have not been entirely satisfactory. As noted, in many applications the specific distribution of the electron beam on the target focal spot, as well as the intensity distribution of the focal spot, are extremely important. A precisely focused electron beam is important for providing an x-ray signal with optimum beam quality, which in turn enhances the quality of the resulting x-ray image. As highlighted above, in many of the existing designs the deflection of the electron beam can degrade the quality of the "focus" of the impinging electron beam, including the shape and intensity of its distribution on the target surface. This can decrease the quality of the x-ray signal and resulting image.

Existing designs—regardless of the deflection mechanism and scheme used—suffer from yet another substantial problem. In particular, the deflector structures of the prior art are subjected to extreme thermal conditions that can damage the cathode structure and limit the operational life of the x-ray tube. As noted when the electron beam impinges on the target location of the anode, a small percentage of the resulting kinetic energy is released as x-rays. However, a substantial portion of the kinetic energy is converted to extremely high levels of heat—upwards of 2500° C.—which is radiated from the anode target. Some of this heat is absorbed into other parts of the x-ray tube, including the proximally located deflector portions of the cathode structure in the above-described prior art tubes. This imposes a large amount of thermal stress on the structure that can damage the cathode and limit its overall operating life.

Thus, there is a need in the art for an x-ray tube that is capable of generating multiple focal spots at different positions on the anode target, and thereby produce multiple x-ray signals having varying angles of incidence and/or energy distributions. In addition, the x-ray tube should be capable of providing precise control over the size, shape and energy distribution of each of the varying electron focal spots. It would also be advantageous to provide an x-ray tube that minimizes any electron emission variation from the filament under changing deflector bias and anode-cathode voltage and configuration conditions. It would also be an advancement in the art to provide an x-ray tube that is stable, and that is not prone to arcing between the anode and cathode, even in the presence of large voltage biases for displacement of the electron beam. Preferably, the x-ray tube would include a cathode assembly that is better able to withstand the extreme thermal stresses imposed by heat radiated from the anode target.

BRIEF SUMMARY AND OBJECTS OF THE INVENTION

It is therefore a general objective of the present invention to provide an improved x-ray tube that is capable of producing multiple x-ray signals having varying angles of incidence and/or energy distributions by varying the focal spot position on an x-ray tube target.

More particularly, it is one primary object of the present invention to provide an improved cathode structure for use in an x-ray tube, that is capable of varying the direction of the electron beam so that it impinges at different focal spots on the anode target.

Another objective of the present invention is to provide an improved cathode structure that is capable of maintaining precise control over the shape, size and energy distribution of the focal spot formed by the electron beam on the target anode.

Yet another object of the present invention to provide an improved x-ray tube that is stable over a wide operating range. More particularly it is an objective of embodiments of the invention to provide a cathode structure that is stable, even at high voltage potentials between the cathode structure and the anode. Similarly, it is an objective of certain embodiments of the present invention to provide a cathode structure that is capable of redirecting an electron beam with deflectors that can be placed at high bias voltages without causing electrical arcing to occur between the cathode and the anode.

Another object of the present invention is to provide an x-ray tube that allows for the production of varying focal spots and that yet minimizes any electron emission variation from the cathode filament, and which thereby maintain the focusing capability of the cathode. More particularly, it is an objective of embodiments of the present invention to provide an improved cathode structure that reduces electron emission variation even under changing deflector bias voltages.

Still another object of the present invention is to provide an x-ray tube that is more resistant to high temperatures produced during operation of the tube. More particularly, it is an objective of embodiments of the invention to provide a cathode structure that is protected from the extreme temperatures radiated from the anode target during operation.

Other objects and advantages of the invention will become apparent upon reading the following detailed description and appended claims, and upon reference to the accompanying drawings.

Briefly summarized, these and other objects, features and advantages are provided with an improved x-ray tube. Generally, the x-ray tube includes an anode structure and a cathode structure that are each disposed within an evacuated tube. The anode includes a focal track, or similar anode target area, that, when impinged with electrons emitted from the cathode, generates x-rays.

In a preferred embodiment, the x-ray tube includes an improved cathode structure, which is capable of providing at least two important functions. First, it provides for the emission of an electron beam that creates a focal spot on the anode target that has precise dimensions, shape, size and electron distribution. Precise control over these local spot characteristics results in the production of an x-ray signal that provides an improved x-ray image. Secondly, embodiments of the improved cathode structure allows for the production of multiple focal spots on the anode target at varying positions. In this way, x-ray signals having different intensity levels, and/or varying angles of incidence can be produced, depending on the position of the focal spot on the anode target.

In a preferred embodiment, the cathode structure includes a means for emitting electrons, such as a single filament that, when heated, discharges electrons. The preferred cathode structure further includes a primary means for focusing the electrons emitted from the filament, such as a cathode focusing cup. This cathode cup is supported on a cathode support base structure, which provides support to the entire cathode assembly within the evacuated tube relative to the anode target. In one preferred embodiment, the cathode cup is comprised of two focusing arms disposed on opposite sides of the filament. Preferably, each of the focusing arms of the cathode cup are electrically connected so as to be placed at a cathode voltage potential, which is substantially equal to the voltage potential of the filament. During operation, the anode is placed at the anode voltage potential, and electrons emitted from the heated filament are accelerated towards the anode target. The focusing arms of the cathode cup have outer surfaces that are oriented in a manner so as to focus and shape the electron fields at the filament, and deflect electron trajectories in the back side of the filament.

In preferred embodiments, the cathode structure further includes a secondary means for focusing the electron beam that is emitted from the cathode structure. For example, in one embodiment, the focusing means is comprised of a focusing aperture formed in a cap structure. The cap structure can be formed as a hollow cylinder that substantially encloses the cathode cup and filament. Formed within a top surface of the cap is the focusing, aperture. The focusing aperture is positioned relative to the cathode cup and the filament so that the accelerating electrons pass through the aperture. The focusing aperture is of a size and shape that further. Focuses the electron beam so as to obtain a focal spot that has predefined characteristics. Preferably, the cap structure is at the same voltage potential as the cathode cup, and is structurally supported by the cathode support arm.

In preferred embodiments, the cathode structure also includes means for creating a deflection region between the cathode cup and the focusing aperture. This deflection region alters the trajectory of the electron beam, thereby causing the position of the focal spot on the anode target to shift accordingly. In one preferred embodiment, the deflection means is comprised of two deflector grids or plates that are disposed on opposite sides of the filament, and at a point above the cathode cup focusing arms. The plates are also disposed within the interior housing formed by the cap structure. Each deflector plate is supported by a separate dielectric support means, each of which are connected to and supported by the cathode support base. Each dielectric support means electrically insulates each deflector plate from the rest of the cathode structure, including the cathode cup. Each deflector plate is electrically connected to a voltage source, which is used to apply a bias potential of sufficient magnitude to each plate that deflects the trajectory of the electron beam. This deflection of the beam direction causes a corresponding shift in the focal spot position on the focal track.

The present cathode structure provides a variety of advantages over the prior art. In particular, the dual focusing arrangement provided first by the cathode cup focusing elements, and second by the focusing aperture, provide an increased level of focusing and control over the electron beam and resulting focal spot. Moreover, the cathode cup provides an electron beam that has very little emission variation from the filament—even in the presence of an applied potential at the deflector plates. Consequently, a focal spot having precise dimensions, shape and electron distribution is obtained, resulting in an improved x-ray image. In addition, embodiments of the cathode structure provide precise control of the focal spot position on the anode target. This is accomplished, for instance, with deflector plates that are separate and distinct from the focusing elements of the cathode. Moreover, increased deflection bias potentials can be utilized to more precisely control the trajectory of the beam without causing electrical arcing between the cathode and the anode. This is due to the cathode cap structure, which is at a fixed potential and is positioned between the cathode structure and the anode. This reduces arcing between those two elements and increases the overall stability of the x-ray tube. Moreover, heating of the deflector plates, the cathode filament and the cathode cup from heat radiated from the anode surface is greatly reduced by the presence of the cathode cap. This reduces the thermal stresses present, and increases the reliability and operating life of the cathode structure.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are not therefore to be considered to be limiting of its scope, the invention in its presently understood best mode for making and using the same will be described and explained with additional specificity and detail through the use of the accompanying drawings in which.

DETAILED DESCRIPTION OF THE PREFERRED EMBODIMENTS

Reference will now be made to the figures, wherein like structures will be provided with like reference designations. It is to be understood that the drawings are diagrammatic and schematic representations of presently preferred embodiments of the present invention and are not limiting of the present invention, nor are they necessarily drawn to scale.

In general, embodiments of the present invention are directed to a novel cathode assembly that addresses a variety of problems in the present art. Namely, a cathode assembly constructed in accordance with the teachings of the present invention provides the ability to generate an electron beam that is sufficiently focused so as to provide a focal spot having desired characteristics—such as shape, dimension and electron distribution. In addition to precise focusing, the cathode assembly of the present invention provides the ability to move the focal spot to different points on the anode target.

Figure 1:
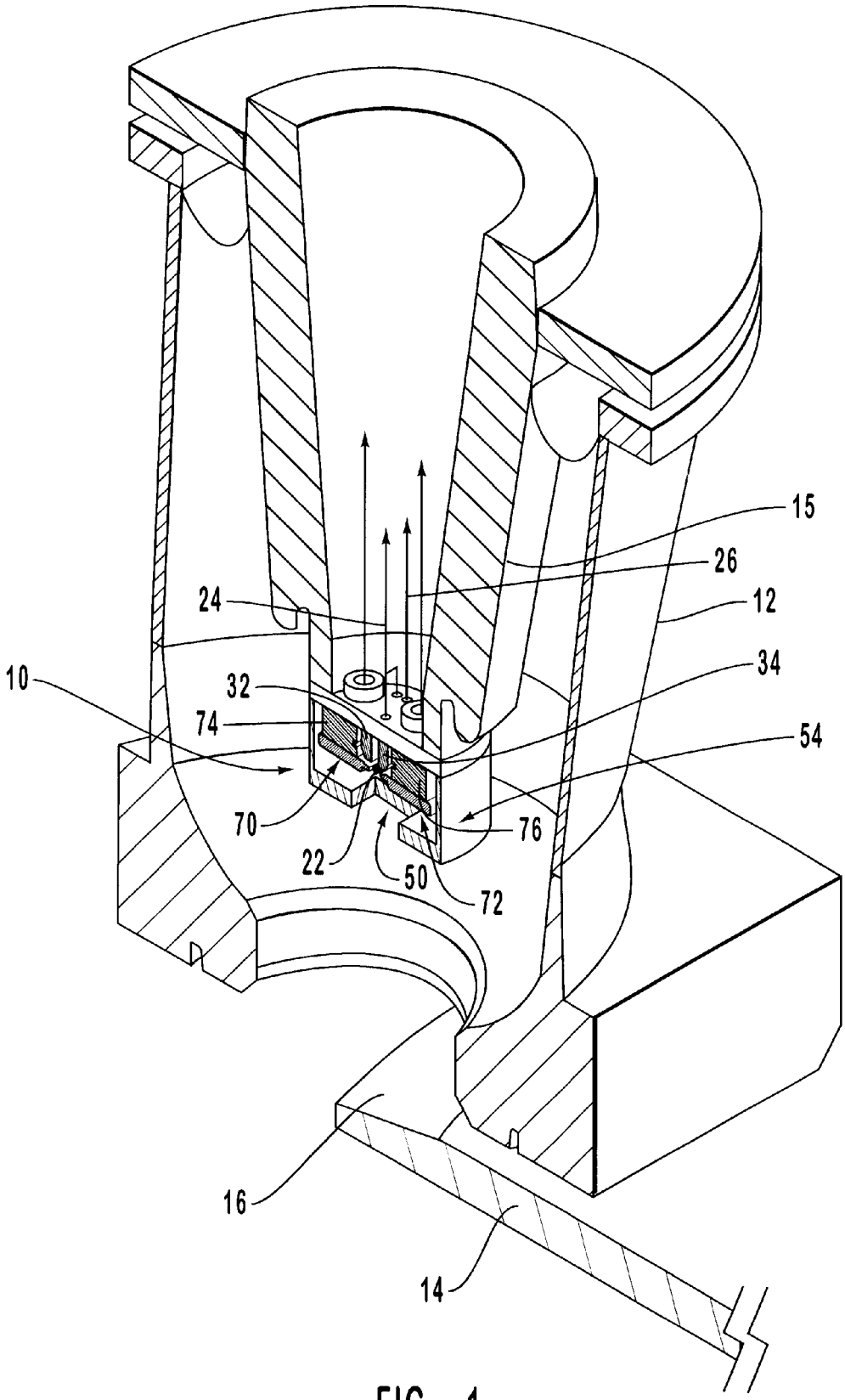
FIG. 1 is a partial cut-away perspective view of the relevant portions of an x-ray tube having one presently preferred embodiment of the cathode assembly.

Referring first to FIG. 1, a portion of an x-ray tube assembly having one presently preferred embodiment of a cathode assembly, which is designated generally at 10, is shown. It will be appreciated that the cathode assembly of the present invention could be used within a standard x-ray tube assembly as would be understood by one of skill in the art; the specific details of the various components within an x-ray tube assembly will not be discussed herein, and are not relevant to the practice and understanding of the present invention. In general, an x-ray tube is formed with an evacuated envelope housing (not shown). Disposed within the x-ray tube evacuated envelope is a cathode cylinder 12, in which is disposed the cathode assembly 10. The cathode assembly 10 is mounted on a rigid support arm 15, which can contain the various conductive leads for supplying electrical power to the cathode assembly 10 (designated, for example, at 21 and 26, discussed further below). Also disposed within the x-ray tube is a rotating target anode 14, which is axially disposed opposite to the cathode assembly 10. A voltage source (not shown) is connected to the anode 14 and the cathode 10, and electrons emitted by the cathode 10 are accelerated when a voltage difference is applied between the cathode and anode. The high velocity electrons stream towards the anode, and impact at a point on the target anode surface 16 referred to as the focal spot (represented in FIG. 4). As is well known, when the electrons impact the anode target surface 16 at the focal spot, a portion of the kinetic energy is converted to x-rays. These x-rays are then partially collimated and emitted through a window (not shown) formed in the side of the x-ray tube. As noted above, the size, shape, and location of the focal spot on the anode target surface will dictate the type and quality of the x-ray signals that are emitted.

Figure 2:
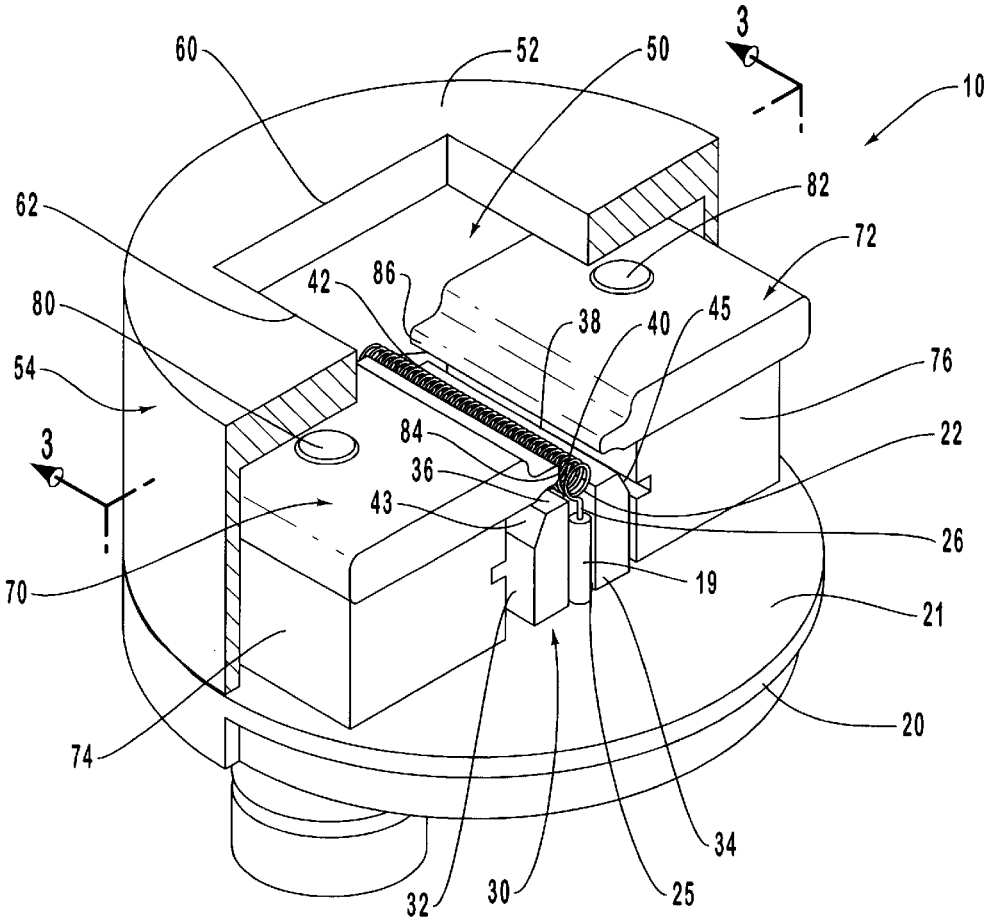
FIG. 2 is a partial cut-away perspective view of one preferred embodiment of the cathode assembly of FIG. 1.
Figure 3:
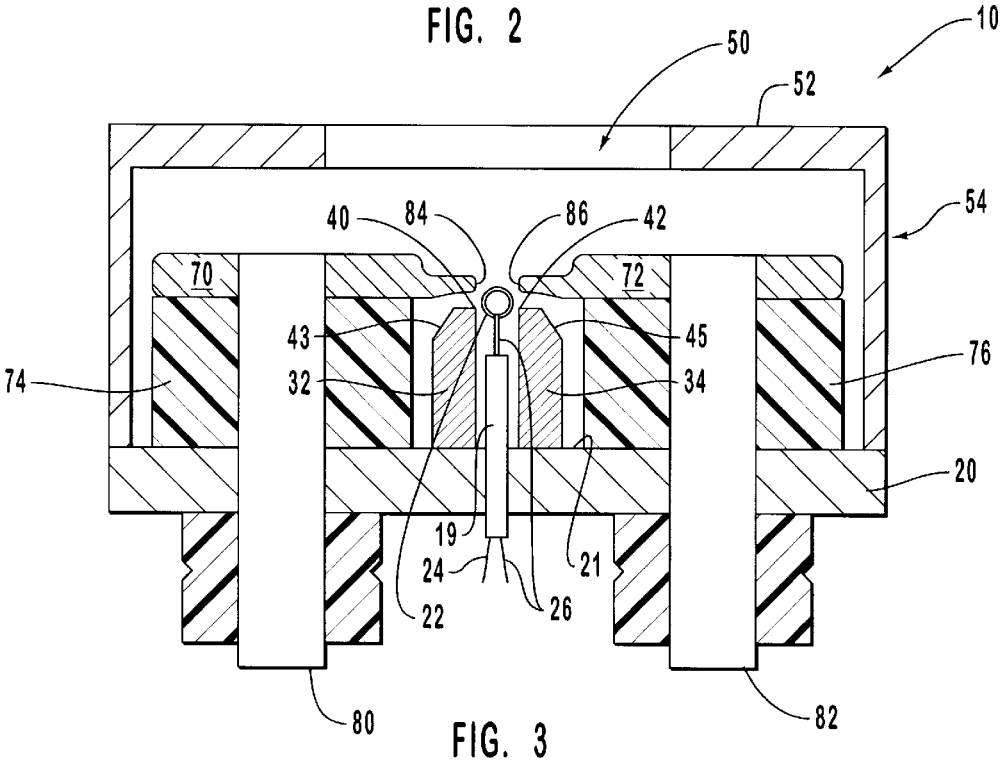
FIG. 3 is a cross-sectional view of the cathode assembly of FIG. 2 taken along lines 3—3.

Reference is next made to FIGS. 2 and 3, which together illustrate one presently preferred embodiment of a cathode assembly 10. In the illustrated embodiment, the cathode assembly 10 includes a support base 20. The support base 20 is rigidly connected to the cathode support arm 15 of FIG. 1 by any suitable means. The support base 20 can be comprised of any suitable material that is capable of withstanding the thermal conditions present within an operating x-ray tube, and can be comprised of an electrically conductive or non-conductive material. In a preferred embodiment, the support base 20 is comprised of a metal or metal alloy, such as molybdenum or a similar material.

Positioned on the front surface 21 of the support base 20 is a means for emitting electrons. As can be seen in FIG. 2, in one preferred embodiment the electron emission means is comprised of a single filament coil 22. The filament has a predefined longitudinal length that runs essentially parallel with the front surface of the support base 20. In the illustrated embodiment, the filament is supported by two electrical leads 22, 24 (and corresponding dielectric support posts, one of which is shown at 19) that extend through the support base 20 to an external electronic circuit and power source (not shown). The filament 22 is comprised of any suitable material, such as tungsten, that is capable of emitting electrons when subjected to a particular energy level. During operation, an electrical current is passed through the filament, and once a minimum energy level is reached, electrons are emitted from the surface of the filament 22.

The cathode assembly 10 preferably includes a primary focusing means for focusing and shaping the electron field that is emitted from the filament 22 surface. Preferably, the focusing means is implemented so as to also deflect electron trajectories in the back side of the filament, which essentially corresponds to electrons emitted from that portion of the filament 22 that is proximate to the front surface of the support base 20, e.g., in the region designated as 25. By way of example and not limitation, in the illustrated embodiment the primary focusing means is comprised of a single cathode cup, designated generally at 30 in FIGS. 2 and 3. Preferably, the cathode cup is comprised of two focusing arms 32 and 34, that are disposed on opposite sides of the filament 22, and are supported and mounted on the support base 20, either directly or by way of an insulating material. Alternatively, the cathode cup 30 can be formed as an integral piece with the support base 20. Each focusing arm 32, 34 has a top surface 36, 38 that forms an edge 40, 42 that is proximate to the filament 22, and that preferably extends substantially along the length of the filament 22. The edges opposite to those at 40, 42, shown at 43 and 45, are formed with an angled surface, so as to allow for the positioning of adjacent deflection plates 70, 72, which are described in further detail below. It will be appreciated that the focusing arms' 32, 34 precise length, height, cross-sectional shape, and proximity to the filament 22 will depend in large part upon the exact type of focusing and shaping that is desired for the electron field emitted from the filament 22 in operation.

Figure 4:
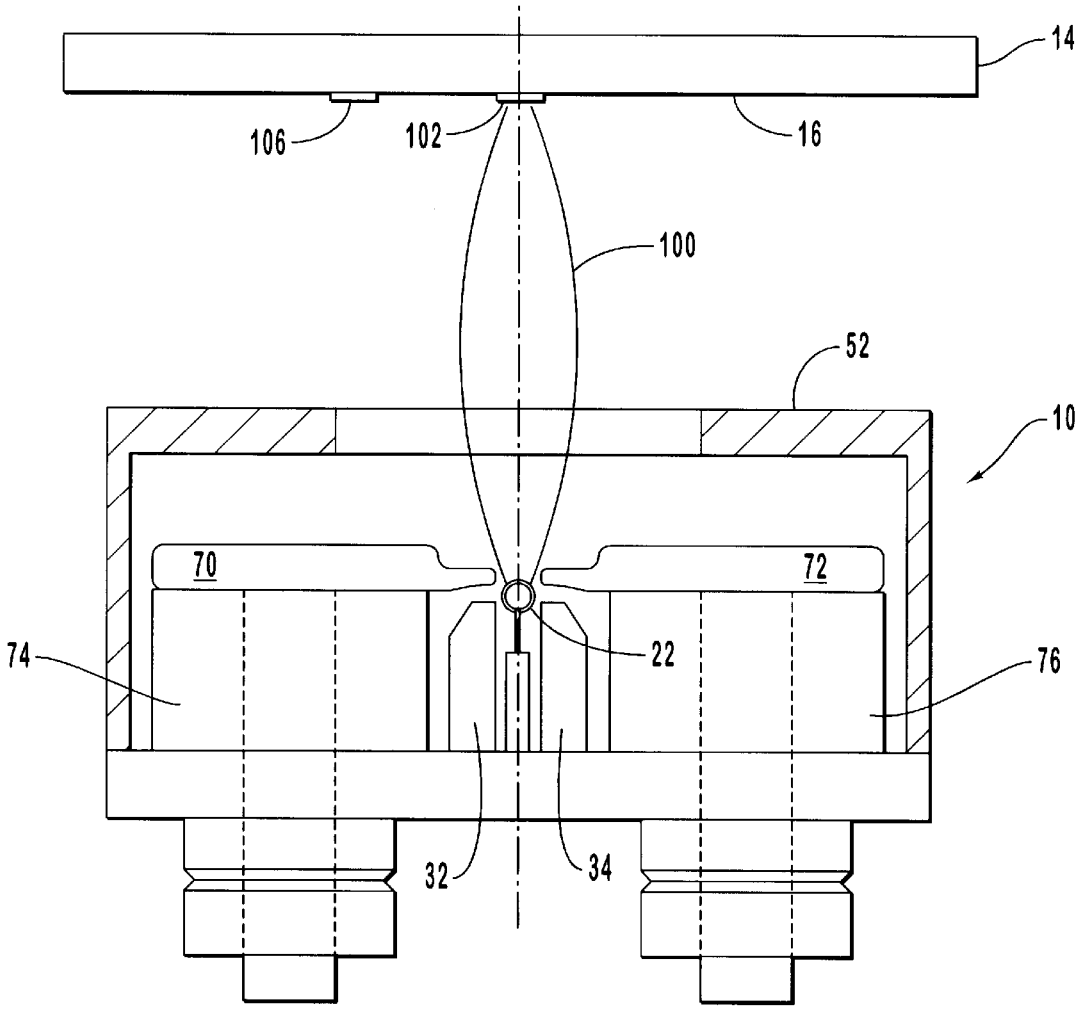
FIG. 4 is a schematic view of the cathode assembly, illustrating an electron beam striking a focal spot on an anode target.

In a preferred embodiment, during operation of the x-ray tube the cathode cup 30 is electrically connected to an external source so as to be placed at a cathode voltage potential. Typically, this cathode voltage potential will be substantially equal to the voltage potential of the filament 22. Likewise, during operation the anode structure is placed at an anode voltage potential. The voltage potential difference between the cathode and the anode cause the electrons that are emitted from the heated filament 22 to accelerate in the form of an electron beam towards the anode target 16. The location on the target surface impinged by the electron beam is the focal spot. This is generally represented in FIG. 4, discussed below.

Preferably, the cathode assembly 10 further includes a secondary focusing means for focusing the electron beam that has been emitted from the filament 22, and that is accelerating towards the anode target surface 16. By way of example, the figures illustrate one presently preferred structure for performing the secondary focusing function as comprising a focusing aperture, designated generally at 50. The focusing aperture 50 is formed in the top surface 52 of a cathode housing, which is shown in the illustrated embodiment as comprising a cap structure 54. In this embodiment, the cap 54 is formed as a hollow cylinder enclosing the cathode cup 30 and the filament 22. Preferably, the cap 54 is disposed on, and is structurally supported by, the front face 21 of the cathode support base 20. Alternatively, an insulator material could be disposed between the cap 54 and the support base 20. In a presently preferred embodiment, the cap structure 54 is placed at substantially the same voltage potential as the cathode cup 30. Also, the cap 54 is comprised of any suitable material which affords resistance to high temperatures, such as various metals or metal alloys.

The exact shape and dimensions of the focusing aperture 50 can be selected based upon the type of focusing effect that is desired for the electron beam, so as to control the electron distribution and intensity on the target at the focal spot. Moreover, since there may not be uniform emission off of the entire length of the filament 22, the shape of the focusing aperture 50 can be used to more precisely control the electron distribution on the target. For example, the aperture can be a rectangular shape, as is illustrated, or it could be circular, elliptical, or it could have a shape having narrower dimensions at the center and wider dimensions at the ends, or vice-versa. In the embodiment illustrated, a focusing aperture having a rectangular shape is used, the dimensions of which are selected to control the shape of the electron beam. For example, the distance between side 60 and its opposing side (not shown) may be less then the length of the filament 22 so as to limit the length of the electron beam in that direction (i.e., along the axis of the filament). Similarly, the distance between sides 62 and 64 may be used to decrease the width of the beam (i.e., in the direction perpendicular to the axis of the filament) and the resulting focal spot.

In addition to providing a secondary focus means, the cap structure 54 provides yet another important function. In particular, the top surface 52 acts as an isolation barrier between the rest of the cathode structure and the anode target structure 14. Moreover, the isolation provided is both electrical and thermal. From a thermal standpoint, the cap 54 protects the rest of the cathode structure from the extremely high temperatures radiated from the anode 14 during operation. Again, this reduces the thermal stresses imposed on the cathode structure, thereby increasing its reliability and operating life. From an electrical standpoint, the cap 54, Which is at cathode cup voltage potential, increases the electrical stability of the x-ray tube because arcing between the cathode assembly 10 and the anode 14 is greatly reduced. This electrical isolation is even more critical when additional voltages are applied within the cathode assembly 10 to steer the electron beam, as is discussed in further detail below.

It will be appreciated that the cathode structure 10 described to this point, i.e., as comprising a filament, a cathode cup acting as a primary focusing means, and a housing in the form of a cap with a secondary focusing means, would be functional and have application in x-ray tubes used in applications requiring a precisely focused electron beam and resulting focal spot. However, in a presently preferred embodiment, the cathode structure also includes means for creating a deflection region between the cathode cup 30 and the focusing aperture 50. This deflection region can be used to alter the trajectory of the electron beam, thereby causing the position of the focal spot on the anode target to shift accordingly. In this way, multiple focal spots can be created on the target surface so as to thereby create multiple x-ray signals.

By way of example and not limitation, the illustrated embodiments implement the deflection means with two deflector grids or plates 70 and 72. The plates 70, 72 are mounted on rigid support arms 74 and 76, that are mounted on the support base 20. The support arms 74 and 76 are comprised of a non-conducting material so that each of the plates 70 and 72 are electrically insulated from the rest of the cathode assembly, including the cathode cup 30 and the cap 54. In addition, means for applying a bias voltage to each plate is provided, which typically would comprise some sort of electrical conductor that is connected to each plate. For instance, in the illustrated embodiment a metal screw 80 is connected to plate 70, and screw 82 is used to connect to plate 72. Each of the screws 80, 82 extend through the corresponding support arm 74, 76 and through the support base 20, so as to be accessible to an external voltage supply (not shown).

In the illustrated embodiment, each of the plates 70 and 72 are mounted on the respective support arms 74 and 76 so as to be disposed on opposite sides of the filament 22. As is best seen in the cross-sectional view of FIG. 3, each plate includes a projecting edge 84 and 86 that extends to a point that is above the cathode cup focusing arms 32, 34, and proximate to the top surface of the filament 22. The length of the edge 84, 86 that is formed by the plates 70, 72 can vary, and in the illustrated embodiment is approximately equal to the longitudinal length of the filament 22. Moreover, in preferred embodiments, the width of the edges 84, 86 is relatively narrow. This reduces any lensing effect that may otherwise be imposed on the beam. Thus, the plate structure does not compromise the focusing of the beam. Also, each plate 70, 72 is rigidly supported by a common support surface—the support base 20. This ensures that the plates 70, 72 maintain a constant position with respect to the electron beam, even after repeated use of the x-ray tube and in the presence of thermal and mechanical stresses.

In operation, bias potentials of sufficient magnitudes are applied to each plate so as to deflect the trajectory of the electron beam, thereby causing a corresponding shift in the focal spot position. Also, application of a deflection voltage can also be used to narrow the electron beam, resulting in a narrower focal spot. Of course, the exact size and shape of the focal spot will also depend on the particular focusing methodology used with the primary and secondary focusing means. Also, the potentials applied to the plates 70, 72 can be varied by an external power supply so that a continuous or intermittent beam of electrons from the cathode assembly 10 may be alternately switched between different focal spots on the target surface.

FIG. 3 illustrates the nature of the electron beam deflection provided by the deflection plates 70, 72. For example, in operation a zero, or some other specified fixed voltage level, is applied to the cathode cup 30 and filament 22 (the cathode voltage). When a voltage is applied to the anode to create a large potential between it and the cathode, electrons formed at the filament 22 will form a beam and accelerate towards the anode target 14. If each of the plates 70, 72 are held at zero voltage potential, then the electron beam, the which is approximately represented by schematic line 100 in FIG. 3, is focused at a focal point 102 on the target surface 16. In this case, the focal point is located at the axis line shown at 104.

If needed, the plates 70 and 72 can be brought to different potentials with respect to one another, and with respect to the cathode cup/filament voltage. This creates a deflection field, which deflects, or redirects, the direction of the electron beam, resulting in a new focal point on the target surface 16. For example, applying a voltage of +4000 volts to plate 70, and −4000 volts to plate 72, deflects the beam towards the plate 70, thereby resulting in a focal spot at, for example, position 106 on anode target surface 16. Reversing the voltage potentials would bend the beam in the opposite direction. Of course, the amount of deflection will be dependent upon the deflection voltages used.

In this regard, the structure of the cathode assembly 10 is particularly advantageous. As noted, the top surface 52 of the housing formed by cap 54 is at cathode voltage potential, and thereby acts as an electrical isolator between the anode and the cathode structure. Thus, much higher deflection voltages can be applied to the deflecting plates 70, 72 without causing instability and arcing between the deflecting plates and the anode. Since larger voltages can be used, a greater degree of deflection of the electron beam is achieved, resulting in greater control and flexibility in selection of an alternate focal spot location. Moreover, this can be accomplished without increasing the distance between the cathode and the anode, and higher emission quality can thereby be maintained.

To summarize, a cathode structure constructed in accordance with the teachings of this invention provides a variety of advantages and improvements over the prior art. In particular, the dual focusing arrangement provided first by the cathode cup, and second by the focusing aperture, provide an increased level of focusing and control over the electron beam and the resulting focal spot. Moreover, the focusing mechanism provided by cathode cup results in an electron beam that has very little emission variation from the filament—even in the presence of an applied potential at the deflector plates. The focal spot thus has precise dimensions, shape and electron distribution, resulting in an improved x-ray image. In addition to the enhanced focusing capabilities, embodiments of the cathode structure provides precise control of the focal spot position on the anode target by creating a deflection region between the two focusing mechanisms. The illustrated deflector plates are separate and distinct from each focusing mechanism—both physically and electrically. Application of a bias to these elements deflects the beam direction resulting in a new focal spot position on the anode target. Use of much higher bias voltages is possible due to the electric isolation provided by the cap housing. Thus, a higher degree of control over the focal spot positions is possible. The housing also protects the cathode structure components from heat radiated from the anode target during operation.

The present intention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A cathode assembly for use in an x-ray tube, the cathode assembly comprising:

a cathode support base affixed to a support arm within the x-ray tube;

means for emitting electrons affixed to the cathode support base;

a primary focusing mechanism affixed to the cathode support base, the primary focusing mechanism having at least one focusing surface proximate to the electron emission means that causes a portion of the emitted electrons to form an electron beam that is directed towards a target surface formed on an anode that is spaced apart from the cathode assembly; and a secondary focusing mechanism, the secondary focusing mechanism having a focusing aperture through which the electron beam passes to impinge on the target surface at a focal spot, wherein the focal spot has dimensions that are at least partially controlled by the dimensions of the focusing aperture.

2. A cathode assembly as defined in claim 1, wherein the means for emitting electrons is comprised of a single filament.

3. A cathode assembly as defined in claim 1, wherein the primary focusing mechanism is comprised of a cathode cup having first and second focusing arms affixed to the support base and disposed adjacent to the electron emission means.

4. A cathode assembly as defined in claim 1, wherein the secondary focusing mechanism is comprised of a housing supported by the support base, and wherein the housing includes a top surface that has the focusing aperture formed therein.

5. A cathode assembly as defined in claim 4, wherein the focusing aperture is rectangular in shape.

6. A cathode assembly as defined in claim 1, further comprising a deflection region disposed between the primary focusing mechanism and the secondary focusing mechanism, the deflection region being comprised of a voltage potential which can be varied so as to control the location of the focal spot on the target surface.

7. A cathode assembly as defined in claim 1, further comprising at least two deflector plates that are each affixed on rigid support members apart from the primary focusing mechanism and the secondary focusing mechanism, the deflector plates each having at least one electrical conductor for applying a plurality of voltage potentials between the plates.

8. A cathode assembly as defined in claim 7, wherein each of the deflector plates includes a deflector edge that is positioned substantially adjacent to the means for emitting electrons.

9. An x-ray tube comprising:

an evacuated housing;

a cathode and an anode disposed within the evacuated housing so that the cathode is spaced apart from a target surface formed on the anode and the anode is placed at a positive voltage relative to the cathode;

a support arm capable of rigidly supporting the cathode within the evacuated housing relative to the anode;

a cathode support base rigidly affixed to a support arm; and wherein the cathode comprises:

a filament affixed to the cathode support base, the filament being capable of emitting electrons when an electrical current is passed therethrough;

a cathode focusing cup mounted on the cathode support base, the focusing cup having at least two focusing arms that are disposed on opposite sides of the filament so as to cause electrons emitted by the filament to form an electron beam that will impinge on the target surface of the anode at a focal spot; and a plurality of deflector plates that are each affixed on rigid support members affixed to the support base and spaced apart from the cathode focusing cup, the deflector plates each having at least one electrical conductor for applying a plurality of voltage potentials between the plates for controlling the location of the focal spot on the target surface.

10. An x-ray tube as defined in claim 9, further comprising a focusing aperture through which the electron beam passes, the aperture having a predetermined size and shape for controlling the size and shape of the focal spot.

11. An x-ray tube as defined in claim 10, wherein the focusing aperture is formed within the top surface of a housing that is supported by the support base, and wherein the housing substantially encloses the cathode cup, the filament and the plurality of deflector plates.

12. An x-ray tube as defined in claim 10, wherein the focusing aperture is rectangular in shape.

13. An x-ray tube as defined in claim 10, wherein the focusing aperture is circular in shape.

14. A cathode assembly for use in an x-ray tube, the cathode assembly comprising:

a cathode support base affixed to a support arm within an evacuated housing of the x-ray tube;

a filament affixed to the cathode support base, the filament being capable of emitting electrons when an electrical current is passed therethrough, and wherein the electrons are directed towards a target surface of an anode disposed within the evacuated housing while the anode is placed at a positive voltage relative to the cathode assembly;

primary focusing means for focusing and shaping the electrons that are emitted from the filament into a primary electron beam that is directed so as to impinge upon the target surface at a focal spot; and means for creating a deflection region to selectively alter the trajectory of the primary electron beam and change the location of the focal spot on the target surface; and secondary focusing means for focusing the primary electron beam after it has passed through the deflection region in a manner so as to provide a focal spot having predetermined dimensions.

15. A cathode assembly as defined in claim 14, wherein the primary focusing means is comprised of a cathode cup having two focusing arms disposed on opposite sides of the filament and having surfaces that form the electrons emitted by the filament into the primary electron beam.

16. A cathode assembly as defined in claim 15, wherein the means for creating a deflection region is comprised of two deflecting plates affixed to dielectric support arms mounted on the support base, the deflecting plates capable of being selectively placed at different electrical potentials with respect to each other and with respect to the filament and the cathode cup so as to create a voltage deflection region that alters the trajectory of the primary electron beam and move the position of the focal spot.

17. A cathode assembly as defined in claim 16, wherein the secondary focusing means is comprised of a focusing aperture for allowing the primary electron beam to pass therethrough, wherein the aperture has a predefined size and shape that focuses the electron beam to produce a focal spot having a corresponding size and shape.

18. An x-ray tube comprising:

an evacuated housing;

a cathode and an anode disposed within the evacuated housing so that the cathode is spaced apart from a target surface formed on the anode and the anode is placed at a positive voltage relative to the cathode;

a support arm capable of rigidly supporting the cathode within the evacuated housing relative to the anode;

a cathode support base rigidly affixed to a support arm; and wherein the cathode comprises:

a filament affixed to the cathode support base, the filament being capable of emitting electrons when an electrical current is passed therethrough;

a cathode cup having two focusing arms disposed on opposite sides of the filament and having surfaces that form the electrons emitted by the filament into the primary electron beam that will impinge on the target surface of the anode at a focal spot;

two deflecting plates affixed to dielectric support arms mounted on the support base, the deflecting plates capable of being selectively placed at different electrical potentials with respect to each other and with respect to the filament and the cathode cup so as to create a voltage deflection region that alters the trajectory of the primary electron beam and moves the position of the focal spot; and a housing that at least partially encloses and isolates the filament, the cathode cup and the two deflecting plates from the anode, and wherein the housing is at the same electrical potential as the cathode cup.

19. An x-ray tube as defined in claim 18, wherein the housing has formed therein a focusing aperture, the focusing aperture having a size and a shape so as to further focus the primary electron beam and provide a focal spot having a predetermined size and shape.

20. An x-ray tube comprising:

an evacuated housing;

a cathode and an anode disposed within the evacuated housing so that the cathode is spaced apart from a target surface formed on the anode and the anode is placed at a positive voltage relative to the cathode;

wherein the cathode comprises:

a filament affixed to a cathode cup support base, the filament being capable of emitting electrons when an electrical current is passed therethrough;

a cathode cup having two focusing arms disposed on opposite sides of the filament and having surfaces that form the electrons emitted by the filament into the primary electron beam that will impinge on the target surface of the anode at a focal spot; and a housing that at least partially encloses and isolates the filament and the cathode cup from the anode and wherein the housing is at the same electrical potential as the cathode cup.

21. A cathode assembly for use in an x-ray tube, the cathode assembly comprising:

a cathode support base affixed to a support arm within the x-ray tube;

means for emitting electrons affixed to the cathode support base;

a primary focusing mechanism affixed to the cathode support base, the primary focusing mechanism having at least one focusing surface proximate to the electron emission means that causes a portion of the emitted electrons to form an electron beam that is directed towards a target surface formed on an anode that is spaced apart from the cathode assembly;

a secondary focusing mechanism, the secondary focusing mechanism having a focusing aperture through which the electron beam passes to impinge on the target surface at a focal spot, wherein the focal spot has dimensions that are at least partially controlled by the dimensions of the focusing aperture; and at least two deflector plates that are each affixed on rigid support members apart from the primary focusing mechanism and the secondary focusing mechanism, the deflector plates each having at least one electrical conductor for applying a plurality of voltage potentials between the plates.

22. A cathode assembly as defined in claim 21, wherein each of the deflector plates includes a deflector edge that is positioned substantially adjacent to the means for emitting electrons.

* * * * *

UNITED STATES PATENT AND TRADEMARK OFFICE

CERTIFICATE OF CORRECTION

PATENT NO. : 6,438,207 B2
APPLICATION NO. : 09/395709
DATED : August 20, 2002
INVENTOR(S) : Chidester et al.

It is certified that error appears in the above-identified patent and that said Letters Patent is hereby corrected as shown below:

Column 1
Line 37, before "generation" delete "("

Column 6
Line 47, after "focusing" delete ","

Column 10
Line 37, after "cap 54," delete "Which" and please insert --which--

Signed and Sealed this

Fifth Day of October, 2010

David J. Kappos

David J. Kappos
*Director of the United States Patent and Trademark Office*